US005335467A

United States Patent [19]

Oberman et al.

[11] Patent Number: 5,335,467

[45] Date of Patent: * Aug. 9, 1994

[54] COMPACT TRUSS SYSTEM

[76] Inventors: Dave Oberman, 3609 Paseo del Campo, Palos Verdes Estates, Calif. 90274; Christopher L. Teuber, 919 Palms Blvd., Venice, Calif. 90291

[ * ] Notice: The portion of the term of this patent subsequent to Aug. 24, 2010 has been disclaimed.

[21] Appl. No.: 86,172

[22] Filed: Jun. 29, 1993

Related U.S. Application Data

[63] Continuation-in-part of Ser. No. 947,161, Sep. 18, 1992, Pat. No. 5,237,792.

[51] Int. Cl.[5] ..... E04H 12/18

[52] U.S. Cl. ..... 52/645; 52/690; 182/179

[58] Field of Search ..... 52/645, 646, 638, 633, 52/126.1, 126.6, 690, 693, 28; 362/285; 182/179

[56] References Cited

U.S. PATENT DOCUMENTS 5,237,792 8/1993 Oberman ..... 52/645

*Primary Examiner*—Carl D. Friedman
*Assistant Examiner*—Creighton Smith

[57] ABSTRACT

A truss system for supporting stage lights or other entertainment components having a strong frame for protecting the components and a vertically adjustable deck from which the components are suspended and from which the components are highly accessible. Truss systems may be connected together either collinearly or in angled configurations depending on the geometry of the venue. The deck is vertically adjustable in response to the components used and/or the geometry of the venue. Caster legs are also part of the system and they allow easy movement of the system and shock isolation of the components. The deck is cushioned against shock and vibration by interposing helical isolators between the frame and the deck. The system is easy to assemble and disassemble and does not need as much labor as previously.

5 Claims, 16 Drawing Sheets

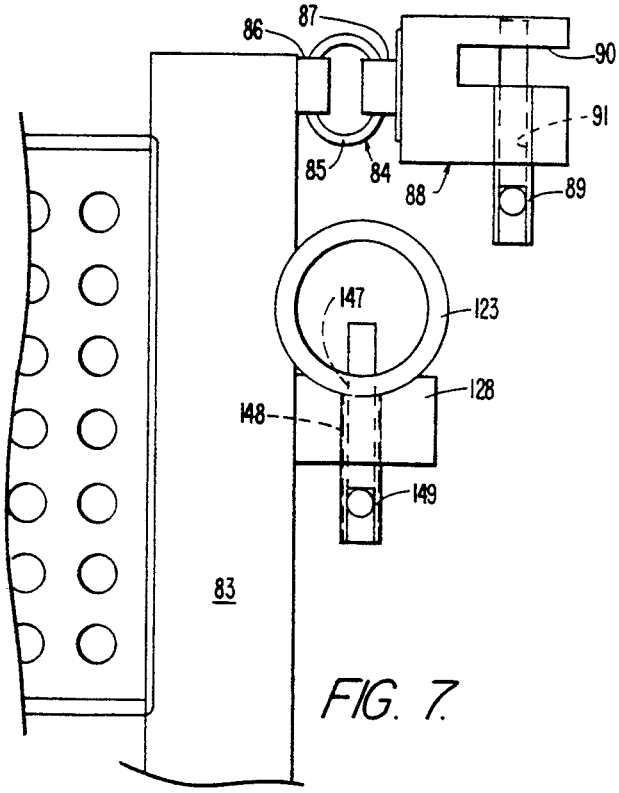
FIG. 7.
FIG. 8a.
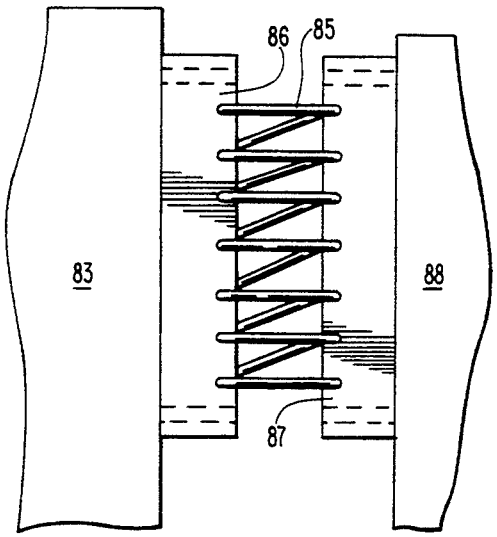
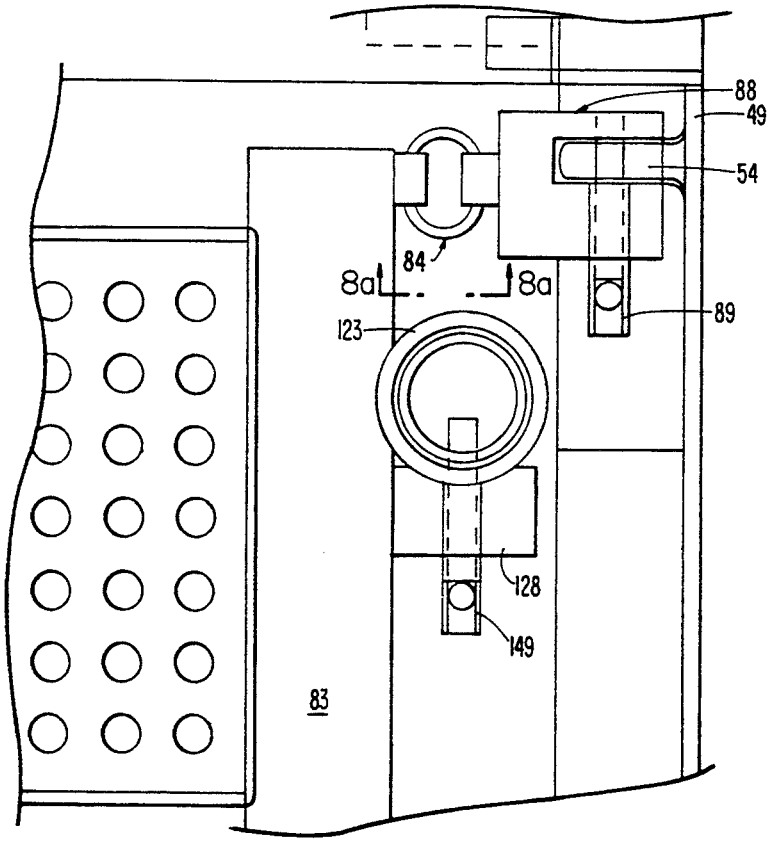
FIG. 8.

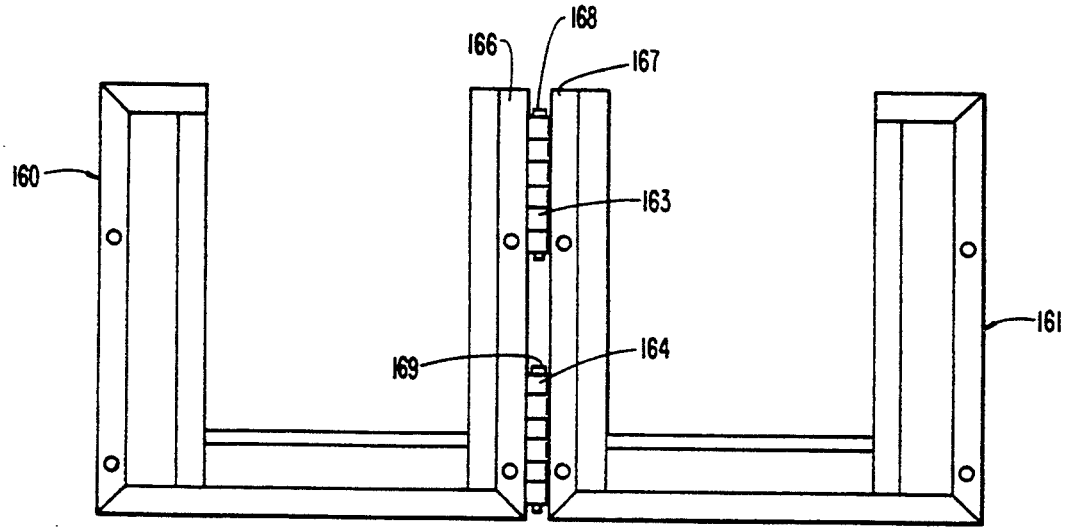
FIG. 14.
FIG. 15.
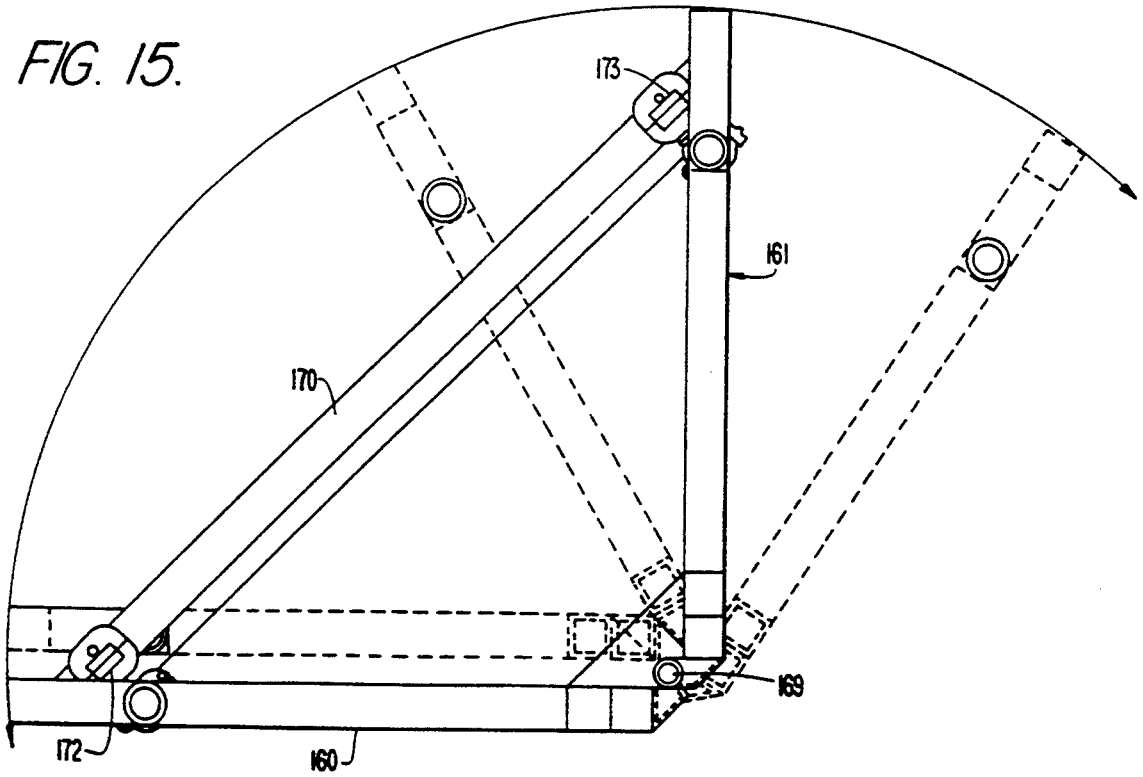

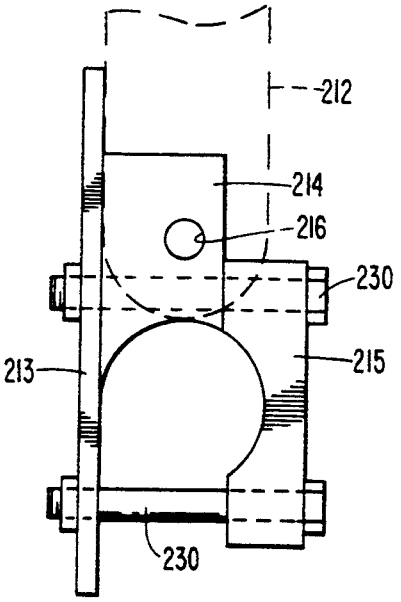
FIG. 21.
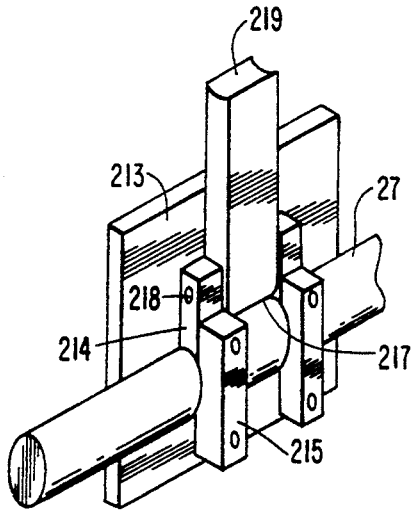
FIG. 22.
FIG. 23.
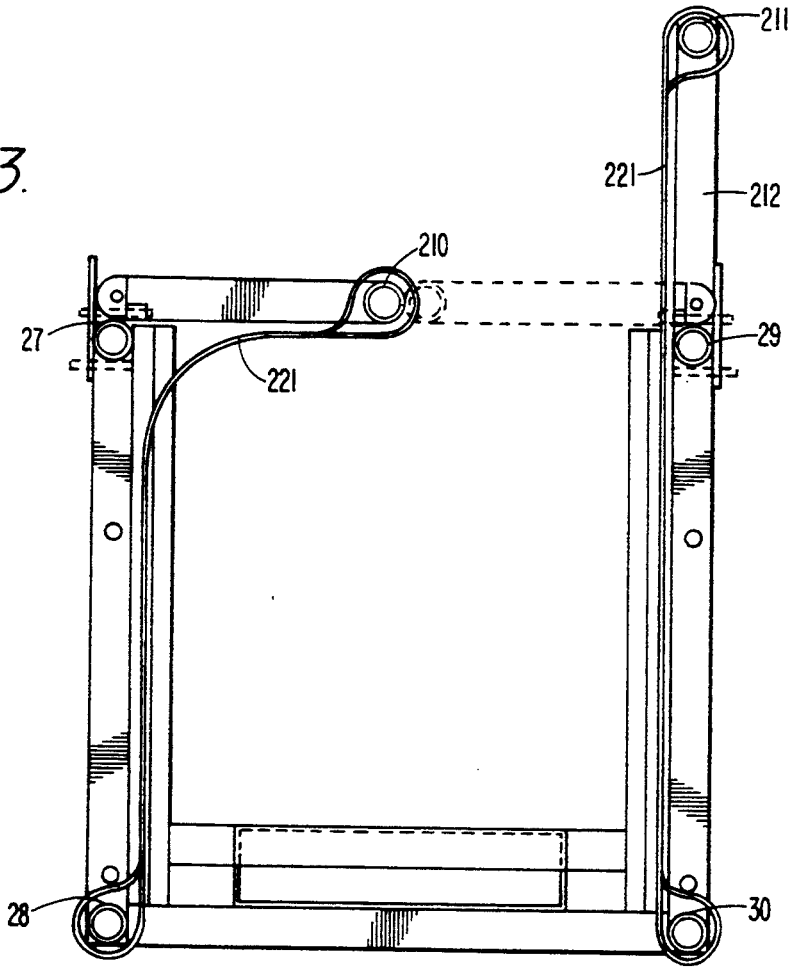

COMPACT TRUSS SYSTEM

BACKGROUND OF THE INVENTION

1. Cross-Reference to Related Applications

The subject application is a continuation-in-part of Ser. No. 07/947,161 filed on Sep. 18, 1992, now U.S. Pat. No. 5,237,792.

2. Field of the Invention

This invention relates generally to support structures, and specifically to an improved compact truss system for supporting lighting and scenery for the musical, theatrical, industrial, television and motion picture fields.

3. Description of the Related Art

Concert entertainers, touring theatrical troupes, industrial shows, and other groups or entities from the entertainment industry often schedule extended tours consisting of a small number of performances in each of a large number of cities. Immediately after the final performance at a venue is completed, the sets and ancillary equipment used during the show are struck, repackaged for transport, and placed on board moving vans which then drive to the next venue where the sets and equipment are again deployed.

In order to compete effectively for consumer dollars by meeting constantly growing expectations by the entertainment seeking public for more elaborate spectacles, shows are increasingly making use of sophisticated lighting systems and frequent changes of scenic backdrops. For example, the direction, intensity and color of each of a plurality of spotlights or other luminaries can be individually controlled by a computer driving a servomechanism to which each light is attached so as to orchestrate complex dynamic lighting effects.

As the sophistication and complexity of stage equipment, particularly lighting systems, for touring shows have increased, the time required to set up and tear down equipment, the number and skill level of stage hands required, and the susceptibility of damage to fragile components during set up and tear down, as well as during movement on and off the transport vehicles, have all become increasingly important factors impacting tour profitability. Equipment broken or jarred so as to be inoperable must be repaired or replaced in time for the next performance. Equipment which is difficult to assemble, disassemble and align can require training and maintaining an unacceptably large and relatively well paid stage crew.

After equipment has been erected at a new location and hoisted above the stage, there is likely to be continuing need for the crew to access in-place components for fine-tuning. For example, set geometries may need to be reconfigured to accommodate the constraints of smaller theaters and convention halls. There is thus a tradeoff between recurring costs for operation and maintenance, and the simplicity of assembly, maintenance and tear down. The movie and television industries face exactly the same concerns.

U.S. Pat. No. 4,862,336 to Richardson et al. discloses a truss unit for supporting a plurality of stage lights which allows each light to direct a beam about an arc of 360° without beam interference by the truss unit. The unit also protectively encases the stage lights during transportation. U.S. Pat. Nos. 4,392,187 to Bornhorst and 4,512,117 to Lange also disclose truss units which support stage lights but which require either removing the lights from the units prior to transportation or adding protective structures.

None of these units, however, provide for all of the following attributes: quick and easy adjustment to the height of suspended equipment components; quick and easy assembly and disassembly; accessing components for replacement or manual adjustment; raising and lowering components easily by individual unit, or multiple units when they are connected to form a single structure; joining units at angles to form non-linear truss structures; requiring a minimal clearance in operation; protecting mounted components from shock when a unit is subjected to severe jarring or is otherwise roughly handled or transported; or transporting units in a horizontal or vertical disposition, whichever maximizes available truck space.

BRIEF SUMMARY OF THE INVENTION

The inadequacies of the prior art have been resolved by the present invention which is an improved compact truss system that is simple, relatively inexpensive and easy to use. The system comprises a pair of lateral members, a pair of end members, a platform connected to the lateral and end members, a set of legs mounted to the platform, a set of casters and bumper means adapted to engage a portion of the end members when the legs are contracted. The bumper means includes a base portion and a tapered nose portion and the end members include a recess to receive the nose portion.

Accordingly, it is an object of the present invention to provide a truss system that is simple yet effective in adjustably connecting a platform deck to a surrounding frame. Another object is to provide a truss system capable of linking at either end with another such system, for supporting lighting or other stage equipment. Another object is to provide a deck within the truss framework whose height can be varied relative to the framework by simply sliding it vertically over a wide range.

Yet another aspect of the invention is to provide a simple, reliable means to adjustably connect supporting legs to a frame. A further aspect is to provide a deck that enables attachment of lighting, scenic and other equipment. Yet another aspect is to provide a truss system which directs loading forces to the stronger parts of the system. An aim of the invention is to provide a system to damp forces acting on supporting casters. Another aim is to provide a deck which facilitates access by workers to components needing replacement or adjustment, both before and after hoisting the system above a stage. Yet another object is to provide a structure that maintains rigidity of the truss system by restraining lateral movement of lateral truss members after the system is hoisted. Still another object of the invention is to have a truss system that operates with minimal clearances.

A further aspect of the present invention is to provide a simple and reliable means for mounting rail extensions. A further aim of the invention is to provide a system with mobility so that it may be readily moved between a van or truck and the interior of a theater, arena, convention hall or other location. Another object is to provide a truss system which is compact and which can be stored or transported in a vertical disposition. Yet a further object is to minimize the shock and vibration of components attached to the deck when the system is in transit, being erected, or being repackaged for storage. Still another object is to provide a system that can be quickly assembled and disassembled so as to minimize labor costs. One more aim of the invention is to provide a system that is relatively simple and inexpensive, yet reliable. And still another aspect is to provide a cover about the lateral members.

A more complete understanding of the present invention and other objects, aspects, aims and advantages thereof will be gained from a consideration of the following description of the preferred embodiment read in conjunction with the accompanying drawings provided herein.

BRIEF DESCRIPTION OF THE SEVERAL VIEWS OF THE DRAWINGS

FIG. 7 is an enlarged top plan view of the end portion of the deck showing a portion of the guiding means and the collar.

FIG. 8 is an enlarged top plan view of the end portion of the deck and a portion of the end member.

FIG. 8*a* is an elevational view of the helical isolator (84).

FIG. 14 shows an end elevational view of two hinged interfaces.

FIG. 15 is a top plan view of the extendable brace for maintaining the angle between the two parts of the interfaces.

FIG. 21 is an enlarged side elevation view of the mountings for the rail extensions.

FIG. 22 is a perspective view of the mountings for the rail extension.

FIG. 23 is an end elevation view of yet another embodiment of the invention showing a covering for use with the truss system.

DESCRIPTION OF THE PREFERRED EMBODIMENT

Figure 1:
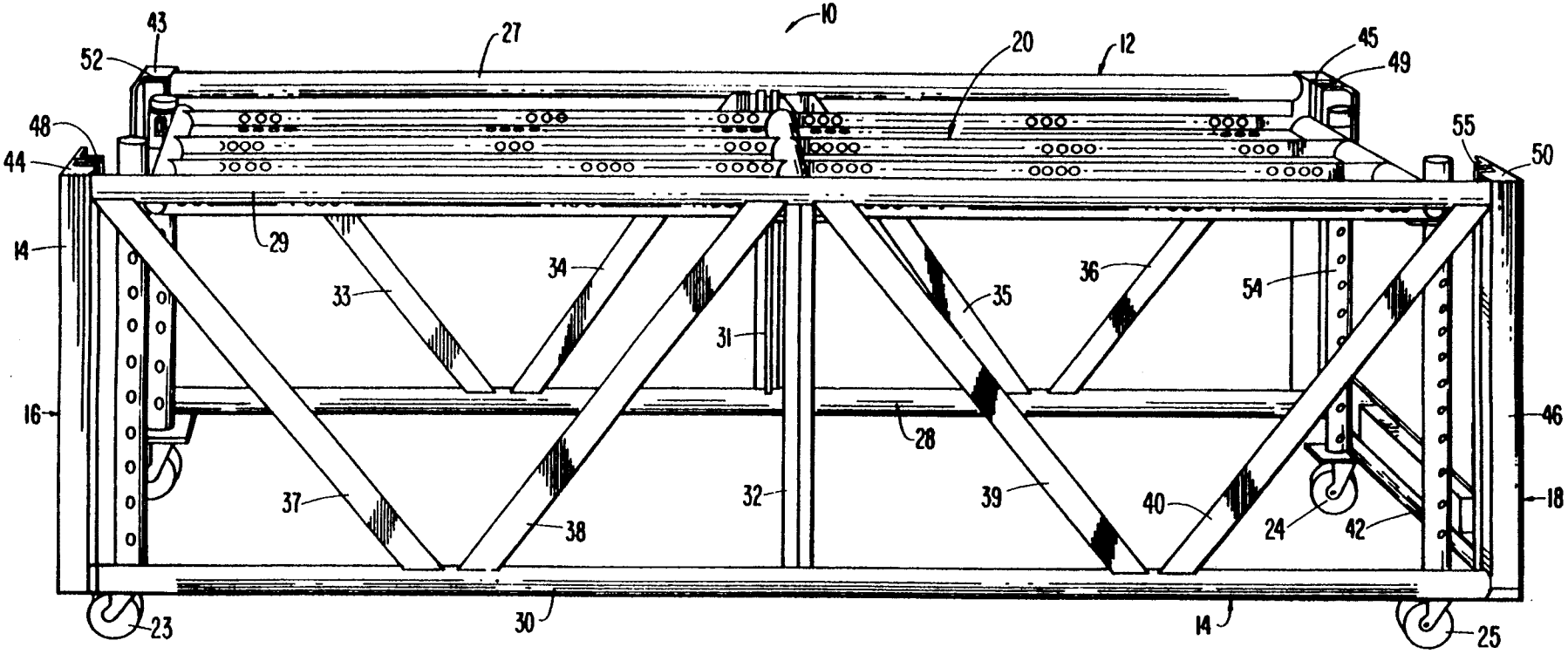
FIG. 1 is a perspective view of a preferred embodiment of an improved compact truss system but without attached lighting components, showing the deck fully raised and the legs fully retracted.

While the present invention is open to various modifications and alternative constructions, the preferred embodiment shown in the drawings will be described herein in detail. It is to be understood, however, there is no intention to limit the invention to the particular form disclosed. On the contrary, the intention is to cover all modifications, equivalences and alternative constructions falling within the spirit and scope of the invention as expressed in the appended claims.

Figure 2:
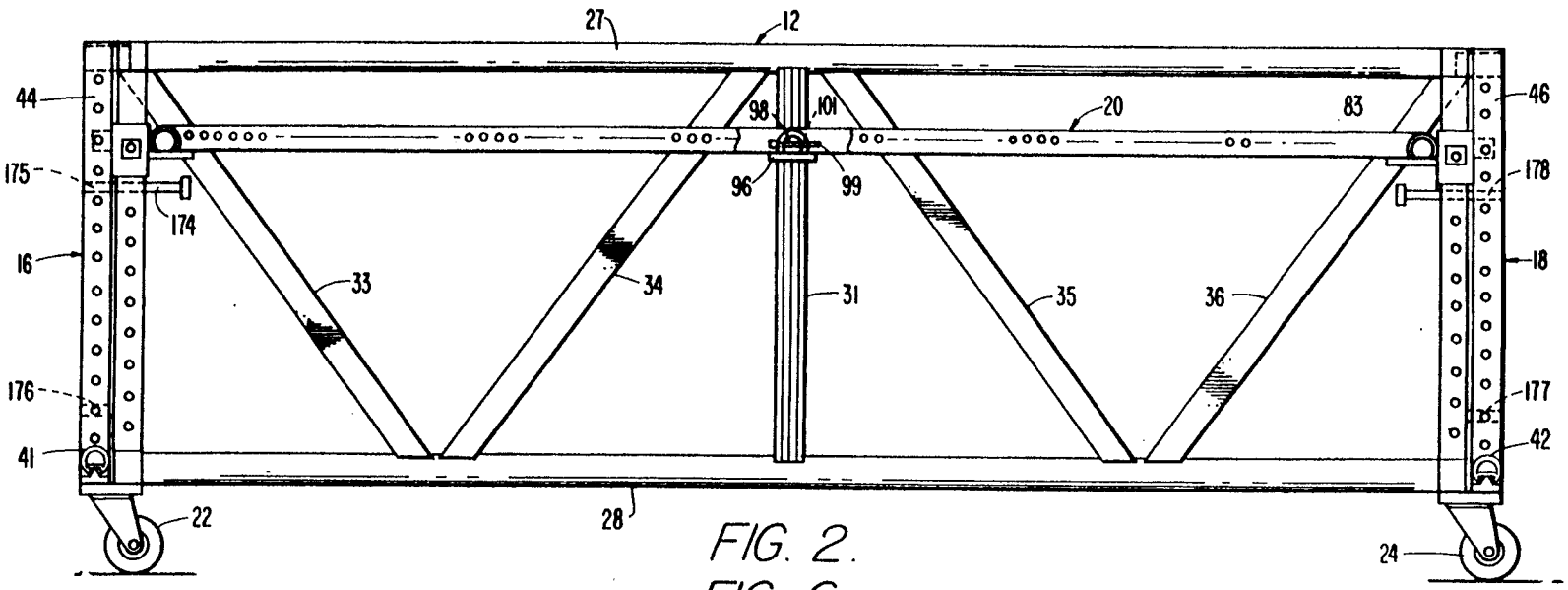
FIG. 2 is a cross-section side elevational view of the embodiment of FIG. 1 illustrating the deck in a slightly lowered position.

The simplicity and reliability of the invention may best be appreciated by considering FIGS. 1 and 2. A truss system 10 includes a frame having opposed first and second lateral members 12 and 14, and opposed first and second U-shaped end members 16 and 18. The system also includes a movable mounting element in the form of a horizontal platform deck 20, and a plurality of casters 22, 23, 24, and 25. The lateral members 12 and 14 are each, respectively, constructed of a pair of top and bottom horizontal, longitudinally extending round tubular beams 27, 28, and 29, 30, central vertical bar beams 31, 32, and two sets of four rectangular tubular crossbeams 33, 34, 35, 36 and 37, 38, 39, 40.

The central vertical bar beams 31 and 32 may consist of two angle irons back to back or may consist of a T-shaped extrusion. The vertical beam 31 extends between and is connected to the horizontal beams 27 and 28, while the vertical beam 32 extends between and is connected to the horizontal beams 29 and 30. The crossbeams 33, 34, 35 and 36 extend diagonally between and are connected to the horizontal beams 27 and 28, while the cross beams 37, 38, 39 and 40 extend diagonally between and are connected to the horizontal beams 29 and 30.

FIG. 1 shows the truss system 10 in its transportation configuration where the deck 20 is positioned near the vertical top of the frame formed by the lateral and end members, generally in the plane defined by the horizontal beams 27, 29. The lateral members 12 and 14 and the end members 16 and 18 form a cage-like frame structure fully enclosing lighting and/or other equipment (shown in FIG. 12 but not shown in FIGS. 1 and 2) attached to the deck 20. In FIG. 2, the deck 20 is shown in a slightly lowered vertical position relative to the lateral and end members.

Figure 6:
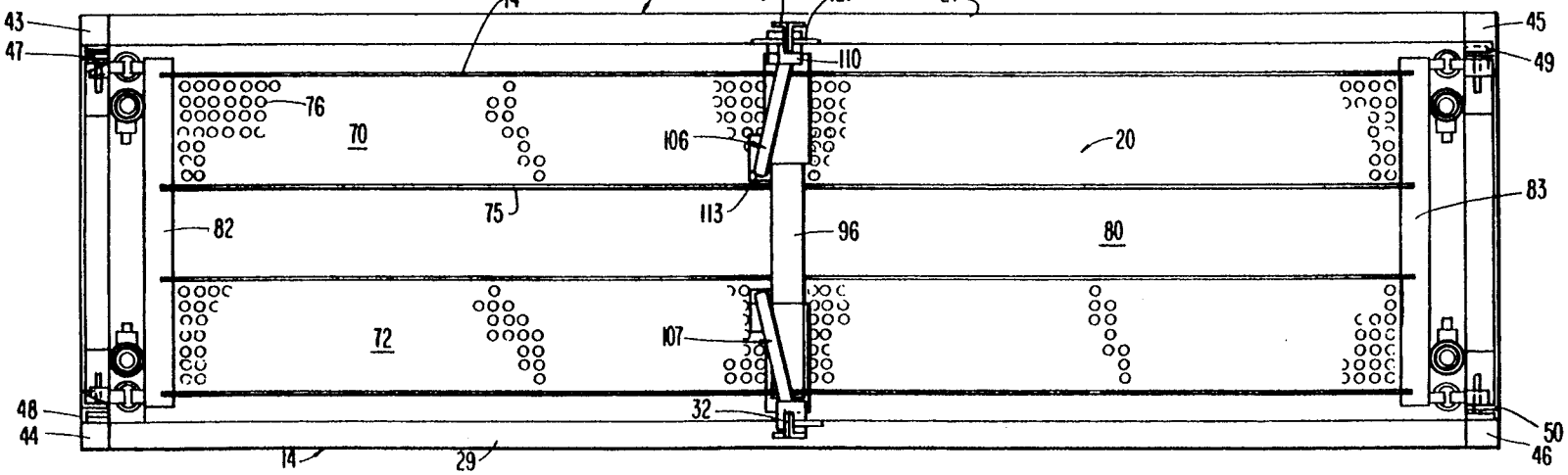
FIG. 6 is a top plan view of the FIG. 1 embodiment and with the diagonal braces in place.
Figure 3:
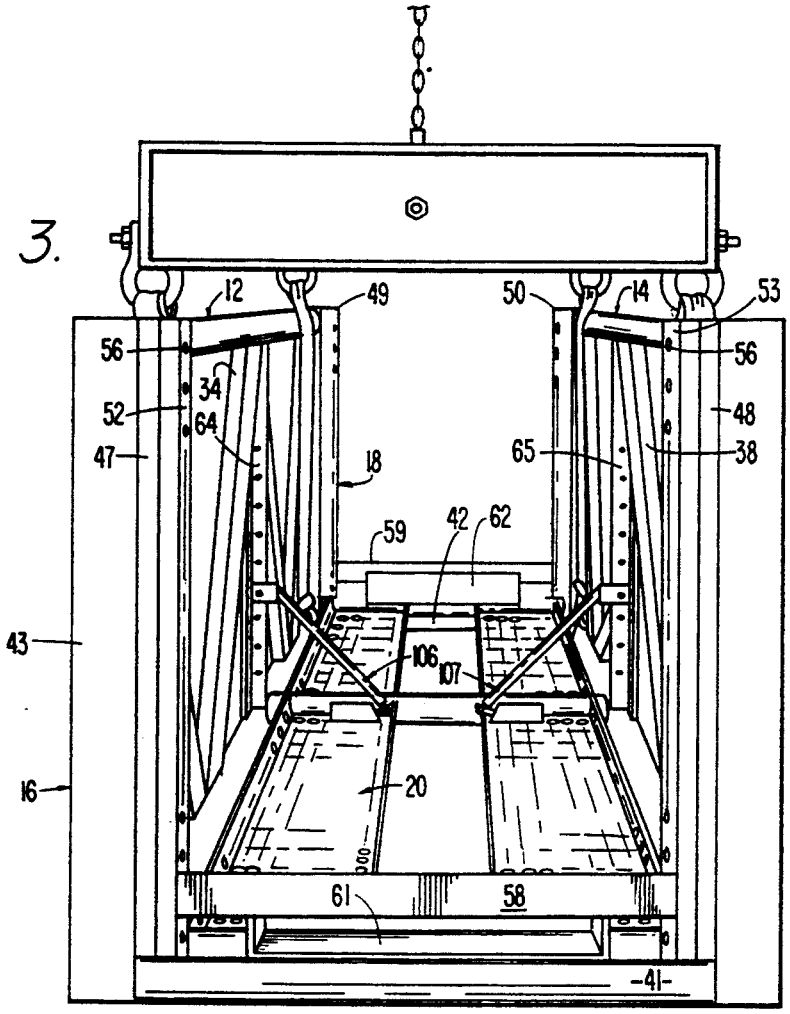
FIG. 3 is a perspective end view of the interior of the FIG. 1 embodiment, showing the deck fully lowered, diagonal braces in place and a hoist mechanism attached.
Figure 4:
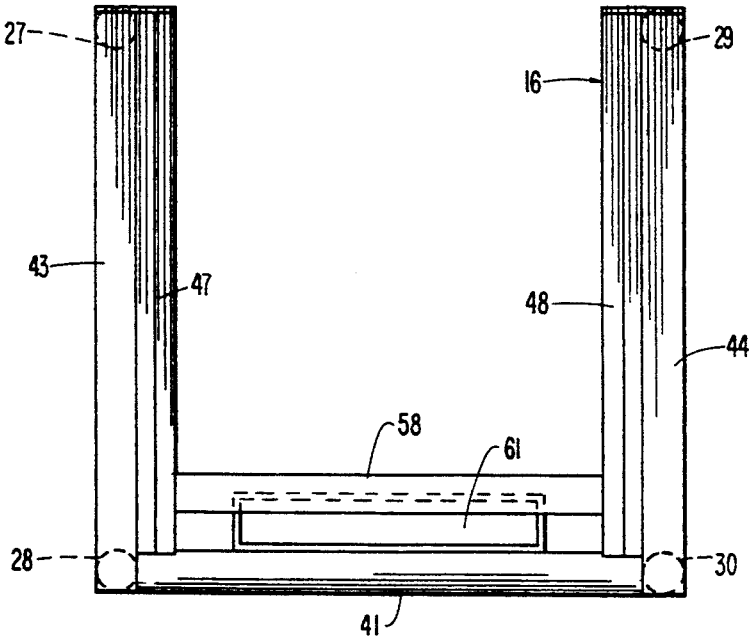
FIG. 4 is an elevational end view of the U-shaped end member of the embodiment of FIG. 1.
Figure 5:
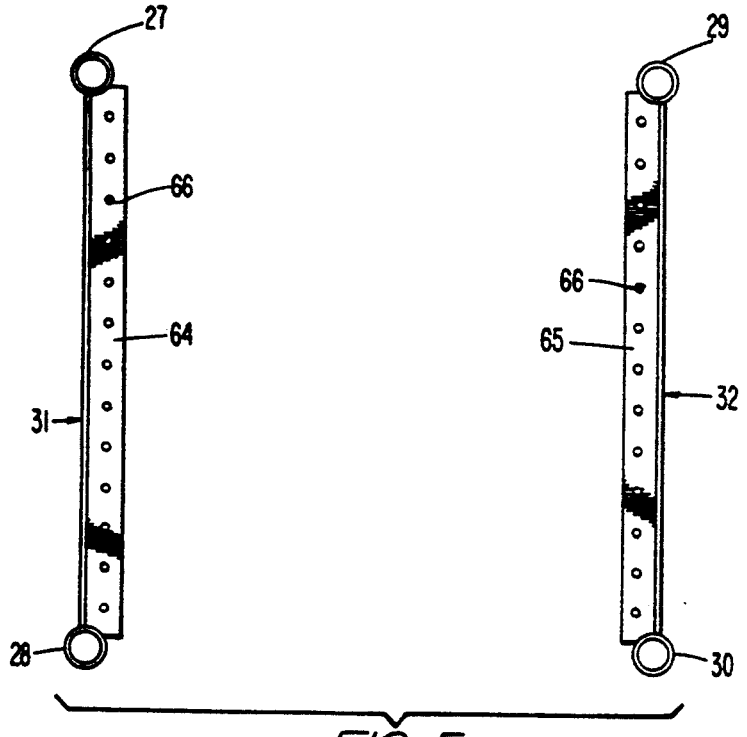
FIG. 5 is an elevational end view of the center T-bar section of the FIG. 1 embodiment.
Figure 9:
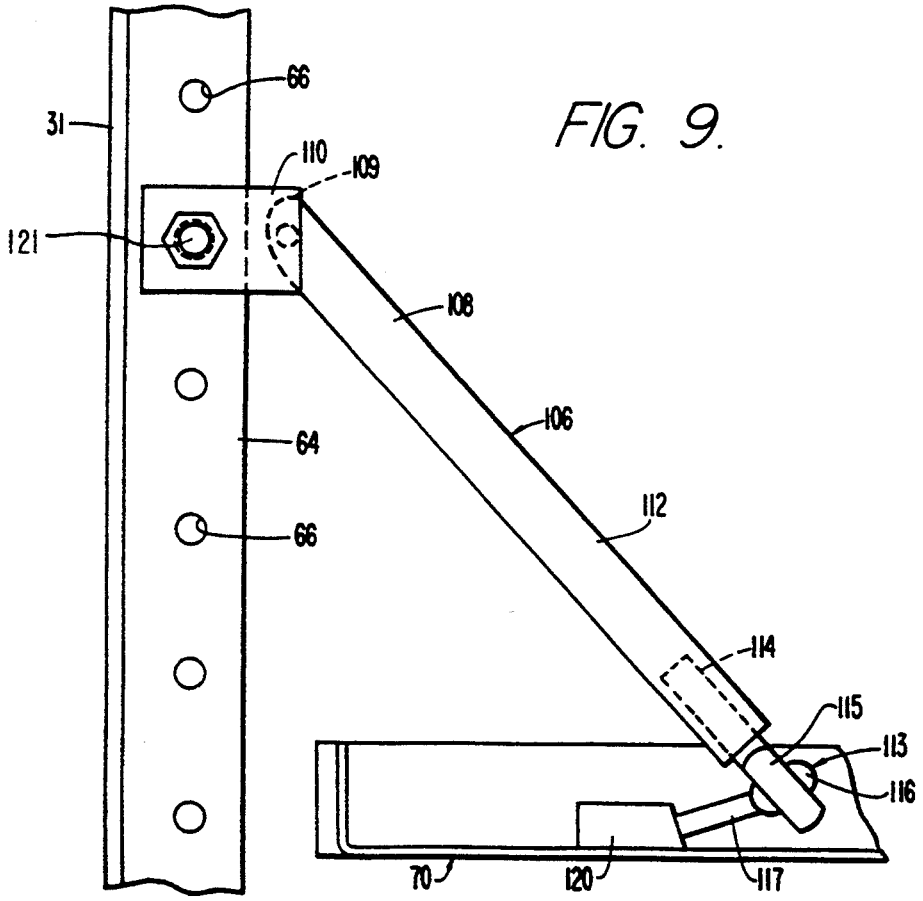
FIG. 9 is an enlarged side elevational view of the adjustable diagonal brace attached to the center T-bar section and to the deck section.
Figure 10:
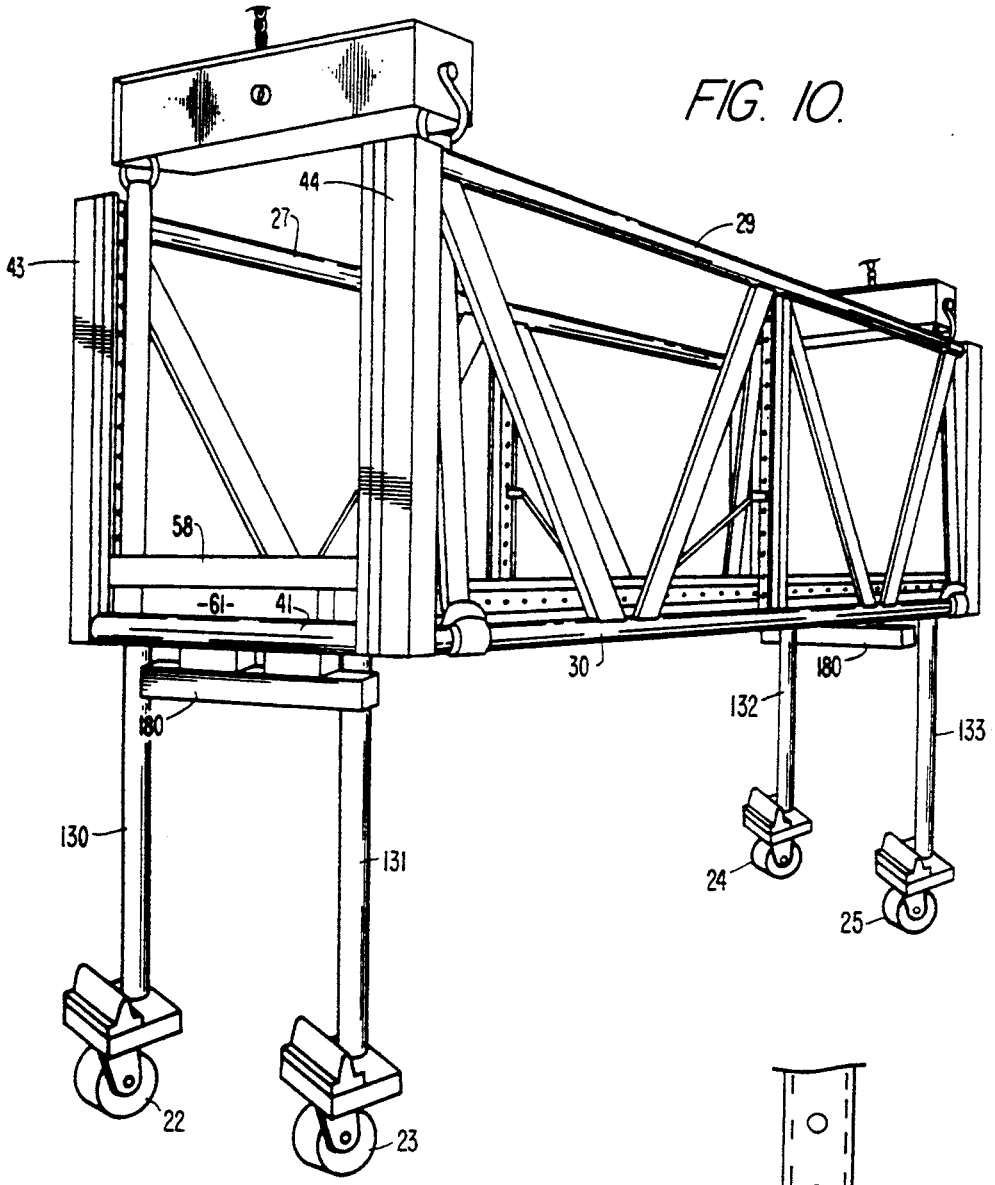
FIG. 10 is a perspective view of the FIG. 3 embodiment, with the deck fully lowered and the legs fully extended.

With additional reference to FIGS. 3, 4, and 6 the simplicity, reliability and efficiency of the system are emphasized. The U-shaped end members 16 and 18 include, respectively, horizontal round tubular beams and aligned holes allows for quick adjustment and quick assembly and disassembly of the entire truss system.

Figure 12:
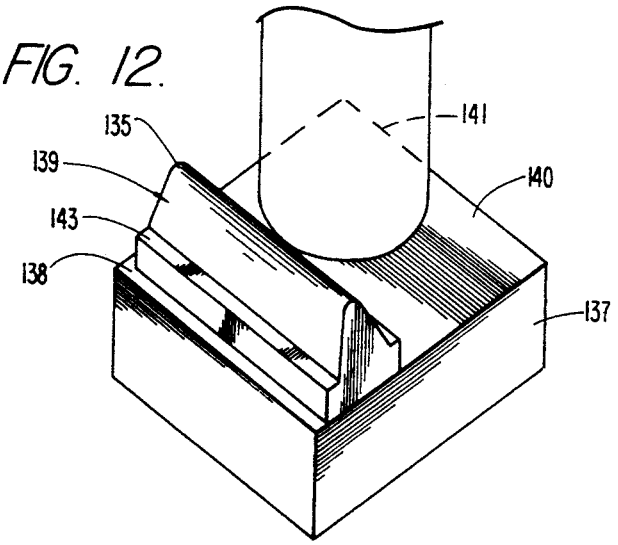
FIG. 12 is an enlarged perspective view of the support pad which illustrates the bumper and the bottom of a leg.
Figure 11:
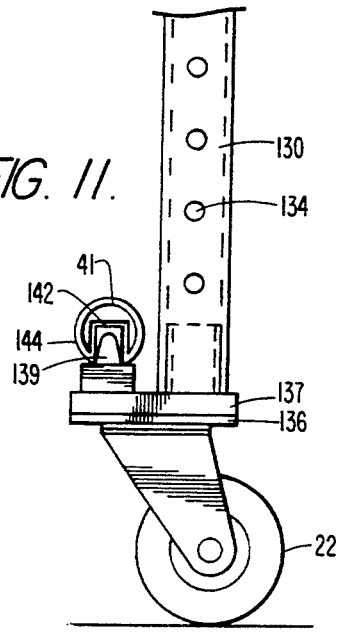
FIG. 11 is a side elevational view of the leg, the bumper and the caster.

As best shown in FIG. 12, the support pad 137 has an upper surface divided into three portions, a pad portion 140, a leg attachment portion 141 and a support portion 138 to which is mounted a shock absorbing means such as an elastomeric bumper 139. The bumper 139 has a nose portion 135 and a base portion 143, where the nose portion is adapted to be received within a recess 142 in the end member's tubular beam 41. The base portion 143 comes in contact with the region 144 of the beam 41 and supports this region and also acts as a cushion. When the truss system is in its transportation mode and is being moved on its casters, any forces acting on the casters are transmitted to the frame beams of the truss system after being damped and are not carried by the legs alone. The casters are commercially available from Albion Industries of Albion, Mich.

Figure 13:
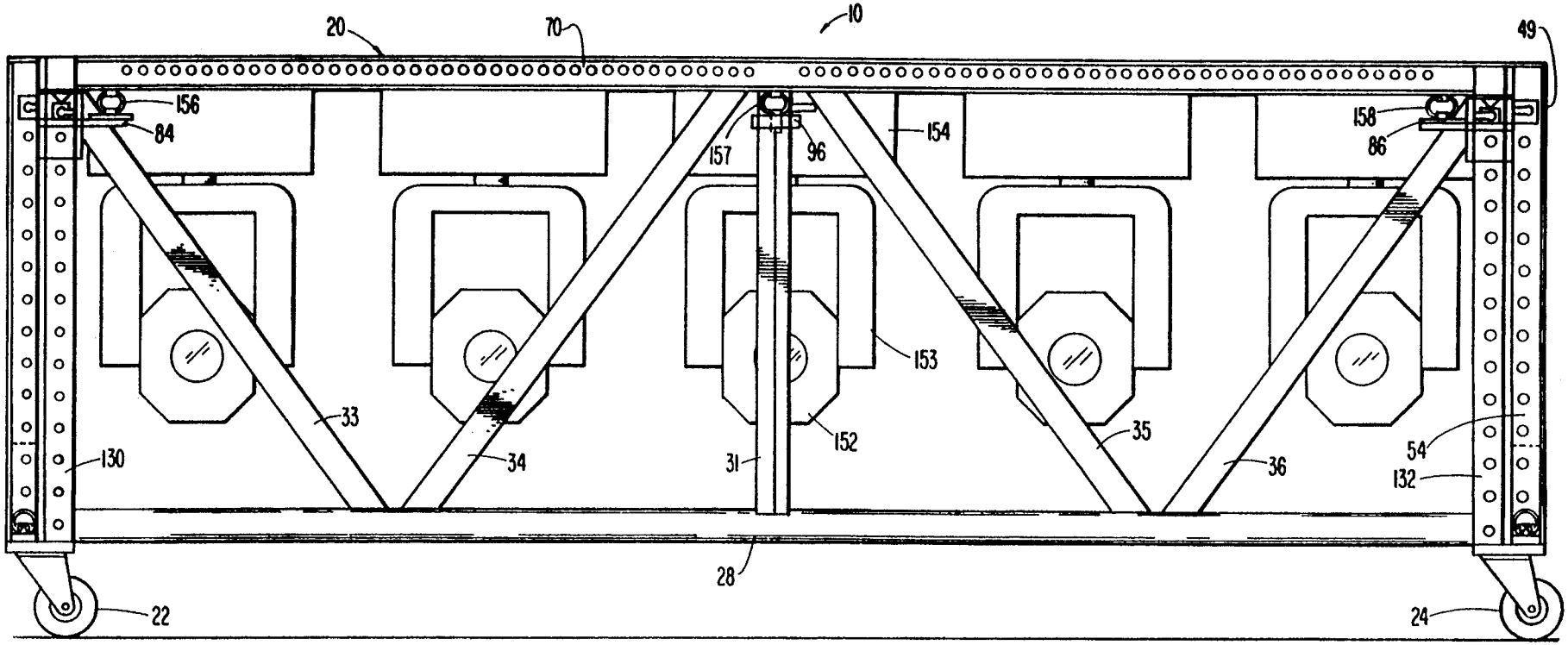
FIG. 13 is a side elevational view of another embodiment of a truss system with the deck fully raised, lighting fixtures suspended from the deck, and the helical isolators mounted between the deck sections and the frame.

FIG. 13 shows a variation of the truss system where the deck 20 is fully raised and the caster legs are fully retracted. This is the system's position used during storage and transportation where the components are protected by the frame formed by the lateral and end members. When transported by truck, the system may be stood upright, that is, rotated 90 degrees from the position shown in the drawing, so that the system is resting on one of its end members. A plurality of components, such as stage lights 152 with yokes 153 are suspended from the deck by means of corresponding attachments enclosures 154. Also illustrated are a plurality of helical isolators 156, 157 and 158, interposed between mounting plates, such as plates 84 and 86, and the deck sections, such as section 70, and between the transverse beam 96 and the deck sections, thereby cushioning the lights from shock and vibration.

The truss system may be linked rectilinearly or at any angle. As shown in FIGS. 13 and 14, hinge means such as linking brackets 160, 161 generally conforming to the U-shape of the end members 16 and 18 and having hinges 163, 164 disposed along adjacent vertical beams 166, 167 can be attached to either or both end members of the truss system. The linking brackets may be attached to adjacent frames by bolts. Rods 168, 169 inserted through the hinge holes complete the hinges. The angle at the vertex of the hinges is maintained by an extendable brace 170 whose ends terminate in clamps 172 and 173 which attach, respectively, to the brackets 160, 161. Clamps are commercially available from Upright Scaffold, Inc. of Berkeley, Calif. Thus, the adjacent truss units may be placed at any preselected angle one to the other.

Figure 25:
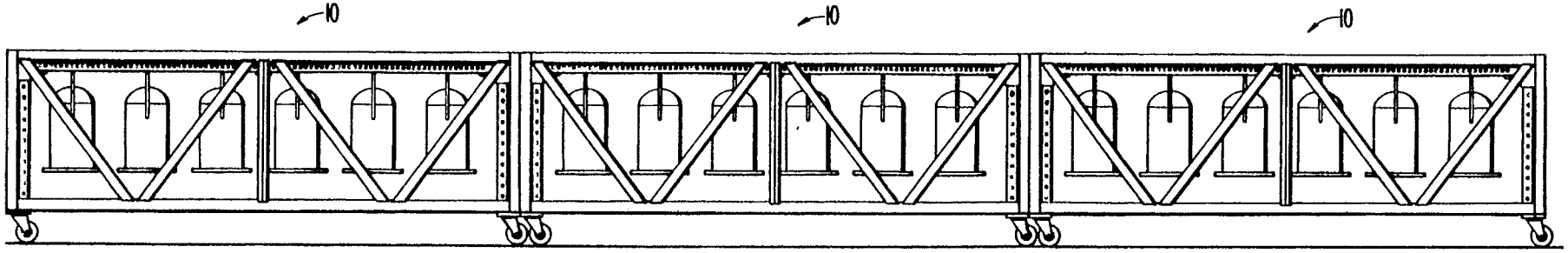
FIG. 25 shows the truss systems of FIG. 24 bolted together.

If the units are to be attached directly one to another, bolts, such as bolt 174 in FIG. 2, may be placed through holes such as holes 175 and 178 and tightened with nuts to secure each frame in a linear disposition, as shown in FIG. 25.

Figure 16:
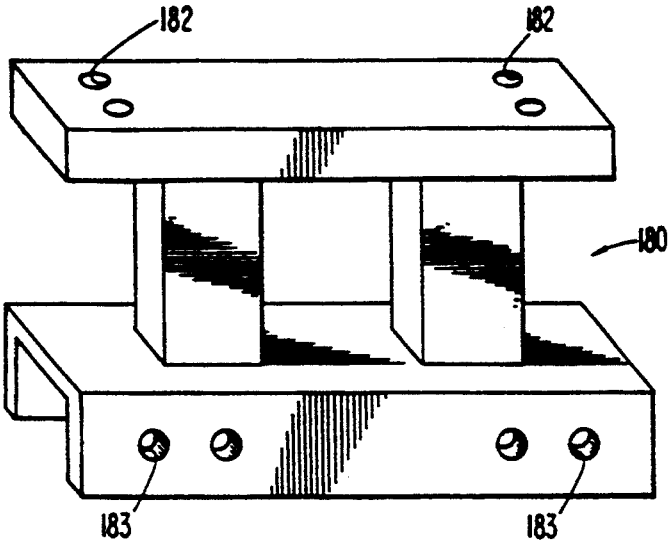
FIG. 16 is a perspective view of the cradle mounting bracket.
Figure 17:
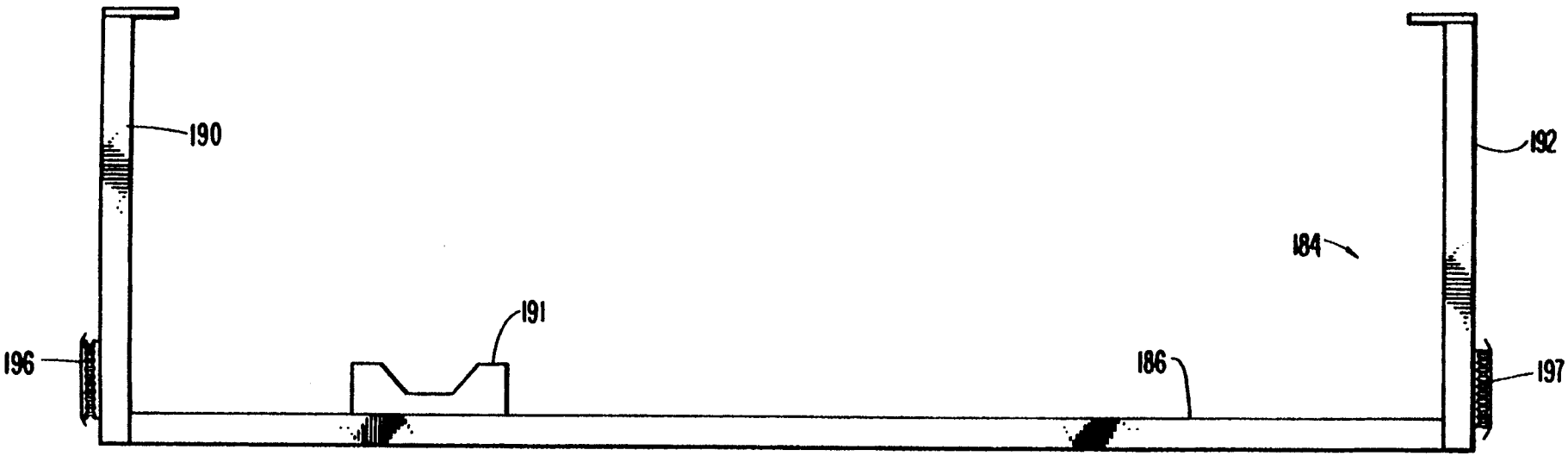
FIG. 17 is an elevational view of the U-shaped restrainer.

Referring to FIGS. 16 and 17, a cradle mounting bracket 180 with pairs of bolt-holes 182, 183 is attached to each tubular beam 82, 83 of the deck prior to transporting or storing the truss system. A pair of U-shaped restrainers 184 each including a horizontal beam 186 and a pair of vertical beams 190, 192 are attached to the brackets 180 by means of bolts through bolt holes in the brackets or by mating latches (not shown). Additional mounting elements, such as a preformed cradle 191 for nesting the components may be connected to the restrainers 184. The restrainers serve to protect suspended components during transport or storage by preventing movement of the components. The brackets 180 and the restrainers 184 are removed prior to operationally deploying the truss system. The restrainer beams 186, 190 and 192 are dimensioned so as to be closely received between the box-shaped members 61, 62 to further isolate the suspended components from shock and vibration.

Figure 18:
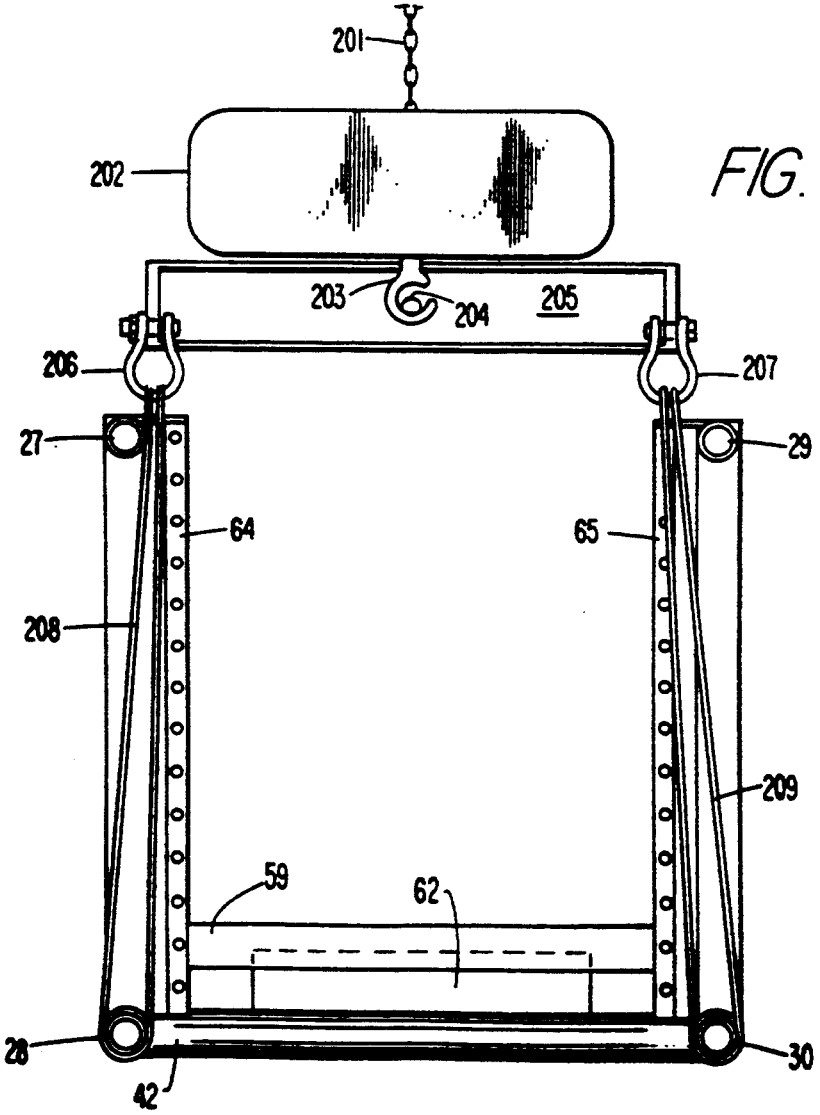
FIG. 18 is a cross-sectional end elevational view of a hoist, a lift bar, and span cables.
Figure 26:
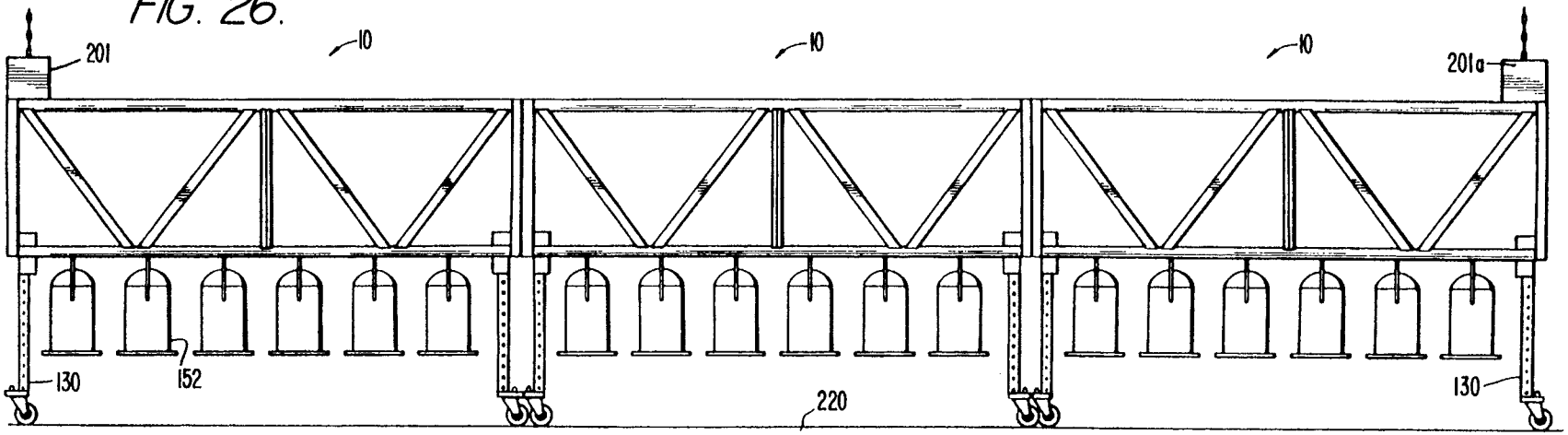
FIG. 26 shows the truss systems of FIG. 24 partially raised, the decks vertically displaced relative to the lateral numbers and the legs extended.

The truss system is moveable between its storage and transportation modes, as already described, to the hoisted position in which the components are exposed and the truss system is suspended above a stage or other floor surface. Referring now to FIG. 18, during operation the truss system may be raised to a desired height by a pair of chain hoisted cables, such as a cable 201. The cable is attached to the lateral members 16 and 18 by means of a housing 202 terminating in a hook 203. The hook is engaged to a pin 204 which is connected to a lift bar 205 formed from a pair of channel members. In turn the left bar is connected to a pair of shackle bolts 206, 207. A pair of span cables 208, 209 pass, respectively, through the shackle bolts 206, 207 and around the longitudinal beams 28 and 30. A chain hoist unit is set up at each end of a span of truss systems as shown in FIG. 26.

The truss system disclosed here may be quickly assembled and disassembled so that labor costs are minimized at the venue sites. In addition, the system allows the platform deck to be adjusted to a preselected suitable vertical level so as to accommodate differences among venue sites and the desires of performers.

Figure 19:
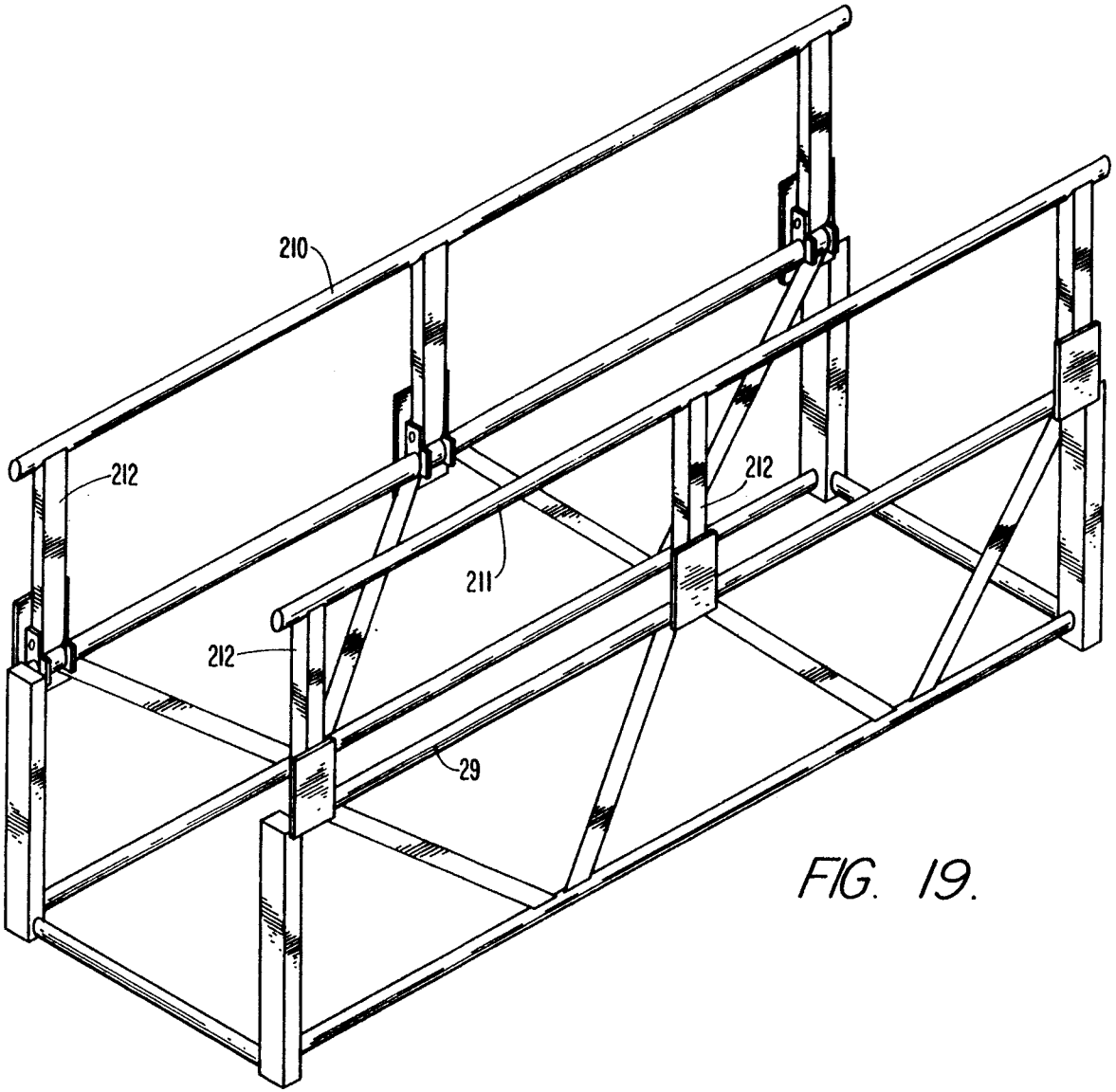
FIG. 19 is a perspective view of another embodiment illustrating rail extensions in an upright position.
Figure 20:
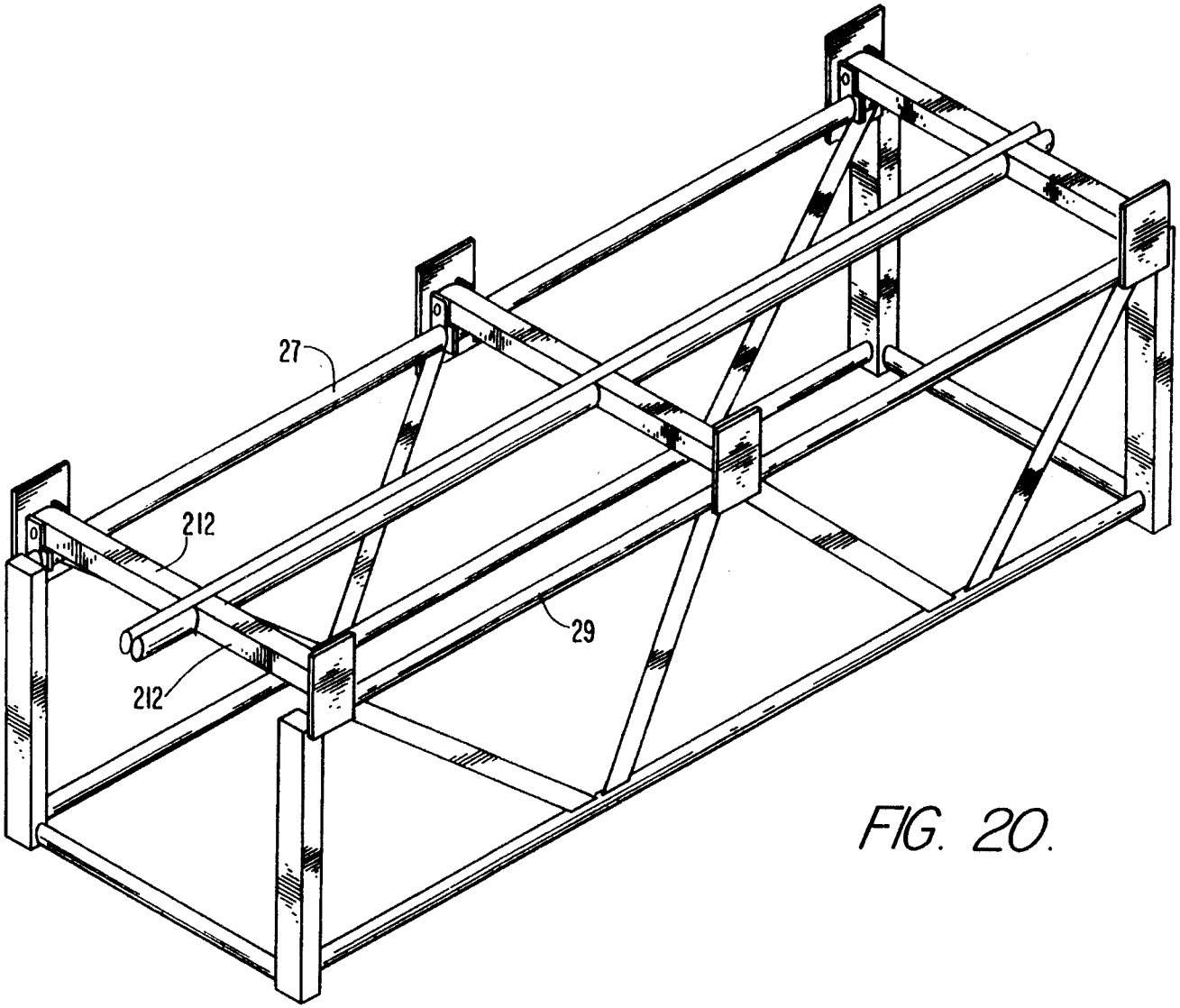
FIG. 20 is a perspective view of the FIG. 19 embodiment illustrating rail extensions in a storage position.

Another aspect of the present invention is to provide a safe working environment for the people handling the truss system and the components which are attached to the system. Referring now to FIGS. 19 and 20 there is illustrated a safety rail extension which may be connected to the truss system. In FIG. 19 the rail extensions comprise moveable elongated elements, such as tubular beams 210, 211 connected respectively to the upper beams 27, 29 of the lateral members. Pivotal support arms 212 are connected to the beams 210, 211 and are configured to position the beams parallel to and spaced away from the upper beams. The arms also allow the beams 210, 212 to move from an upright position as shown in FIG. 19 to a folder storage position as shown in FIG. 20.

When the rail extensions are in their upright positions an operator moving along the platform will have the beams 210, 211 to hold for support and balance. When the rail extensions are in their storage position, they are folded in a compact arrangement to allow easy handling and storage and also to give added protection to the components.

Referring to FIGS. 21 and 22 there is illustrated the means for mounting the support arms 212 which allow the arms to rotate through 90 degrees. The mounting means includes a first part such as a plate 213 a second part such as a bracket 215 and means for pivotally mounting the arm such as a bracket 214. The bracket 214 is shaped to rest on the beam 27 and to abut the plate 213 on one side and the other bracket 215 on the other side. The bracket 214 has a hole 216 for receiving a shaft 218 which also is received by a hole in the arm 212. This allows the arm to pivot using the longitudinal axis of the pin and the longitudinal axis of the hole 216 as a pivot axis.

The bracket 215 abuts the bracket 214 and is mounted to the beam 27 by two bolt/nut pairs 230 where the bolts extends through the bracket 215 and the plate 213 and around the beam 27. Thus, brackets 214, 215 are arranged in pairs about one arm 212 and the arm 212 has a round end 217 to allow it to rotate. The other end 219 is attached to the extension beam 210.

Referring now to FIG. 23 there is illustrated another variation where a fabric or plastic covering 221 is looped at one end around the beam 211 and at the other end around the beam 30. An identical covering is placed to extend from the beam 210 to the beam 28. The coverings offer a partial enclosure as well as the possibility of a decorative background should it be desired.

Figure 24:
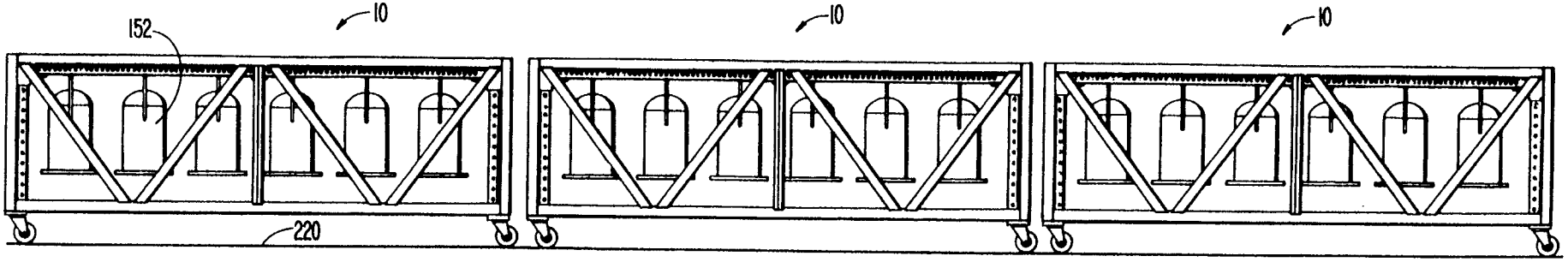
FIG. 24 shows three truss systems aligned on a stage.

In operation and as shown in FIGS. 24, 25, 26, 27 and 28, connecting and operationally deploying a multi-unit truss system entails a sequence of steps. First, the truss systems are transported, usually on end so as to be stacked in a truck with the longitudinal axis of each system in a vertical disposition. When the systems are unloaded they are pivoted to their casters and wheeled off the truck onto a stage 220 and aligned in a preselected position before being connected. FIG. 24 schematically shows the alignment of truss systems in their transportation mode where the suspended components 152 are enclosed and protected. The restrainers shown in FIG. 17 have already been removed if they were used in the first place. The deck is in the fully raised position relative to the frame, and the caster legs are fully retracted.

As shown in FIG. 25, the systems are bolted together in a linear arrangement. As many spans as necessary can be attached in a linear fashion or at angles, depending upon the geometry desired. In FIG. 26, the hoists 201, 201*a* are connected and selected pins are retracted to allow the lateral and end members to be raised to working height above the stage or ground, usually about waist high. It is noted that while the legs are still on the stage floor, suspended components such as the stage lights 152 are exposed and an access way is created on the deck between the raised lateral members.

Figure 27:
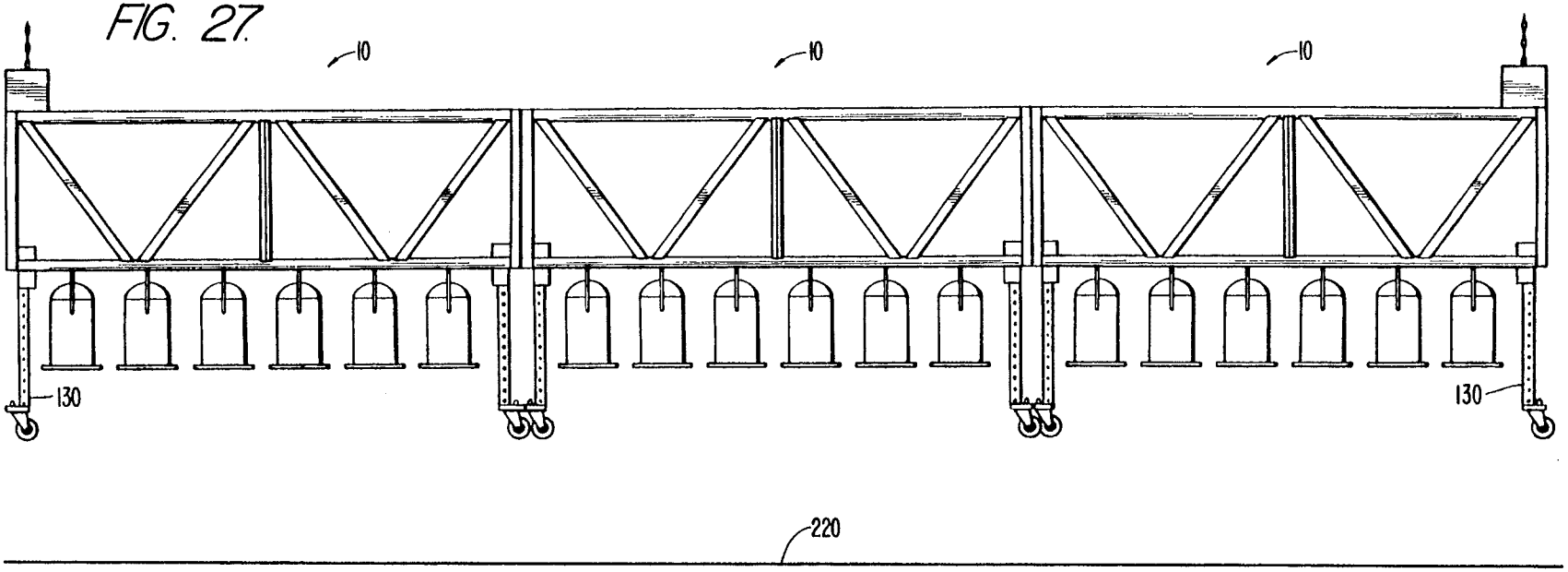
FIG. 27 shows the three-system configuration of FIG. 24 lifted off the stage.
Figure 28:
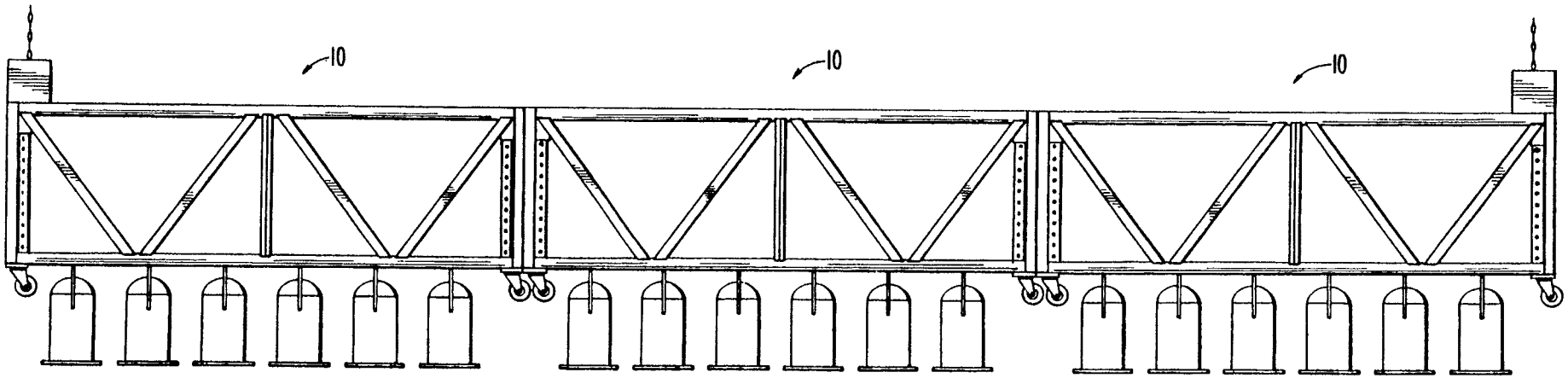
FIG. 28 shows the three-system configuration of FIG. 24 operationally deployed with the legs retracted.

Operators standing on the stage floor 220 can now access the suspended components and adjust or repair them as needed. After the components have been adjusted, the brace assemblies are fixed. In FIG. 27, the multi-span structure is illustrated hoisted above the stage floor a short distance while the legs remain fully extended. The legs are then retracted, and cables and auxiliary equipment are attached. Finally, as shown in FIG. 28, the fully connected truss systems are lifted to a preselected operational height.

It should be noted that little clearance is needed for this operation, unlike some prior art devices where lateral members must be rotated into position and require a large clearance space to function.

After a performance is completed, the above steps are generally reversed and the systems are quickly and easily contracted and disassembled for loading back into the truck for shipment to the next venue. Assembly and disassembly can be accomplished quickly and efficiently with a minimum of labor, thereby enhancing the value of the inventive truss system.

What is claimed is:

1. A truss system comprising:

first and second lateral members;

first and second end members connected to said lateral members;

a platform for mounting components connected to said lateral and end members and adapted to move vertically relative to said members;

a set of legs adjustably mounted to said platform and members, said legs movable from a contracted to an extended position;

a set of casters, one caster connected to each of said legs; and bumper means for absorbing shock connected to said legs and adapted to engage a portion of said end members when said legs are contracted.

2. A truss system is claimed in claim 1 wherein: each leg of said set of legs includes an extended tubular element and a connected plate; and one of said bumper means and one of said casters are connected to said plate.

3. A truss system is claimed in claim 2 wherein: said bumper means comprises a base portion and a tapered nose portion.

4. A truss system is claimed in claim 3 wherein: said end members include a recess for receiving and engaging said bumper means.

5. A truss system is claimed in claim 4 wherein: said recess has a cross section for receiving the nose portion of said abutment means; and another portion of said end members engages the base of said bumper means.

* * * * *